United States Patent [19]

Cohen et al.

[11] Patent Number: 4,588,485

[45] Date of Patent: May 13, 1986

[54] PROCESS FOR THE PRODUCTION OF A METAL BY ELECTROLYZING HALIDES IN A MOLTEN SALT BATH, COMPRISING A SIMULTANEOUS AND CONTINUOUS DOUBLE DEPOSIT

[75] Inventors: Joseph Cohen, Paris; Gérard Lorthioir, Vitry-sur-Seine, both of France

[73] Assignee: Pechiney, Paris, France

[21] Appl. No.: 708,520

[22] Filed: Mar. 5, 1985

[30] Foreign Application Priority Data

Mar. 12, 1984 [FR] France ..... 84 03967

[51] Int. Cl.[4] ..... C25C 3/00; C25C 3/26; C25C 3/32; C25C 3/34

[52] U.S. Cl. ..... 204/64 R; 204/64 T; 204/245

[58] Field of Search ..... 204/64 R, 64 T, 245

[56] References Cited

U.S. PATENT DOCUMENTS 4,392,924 7/1983 Armand ..... 204/64 R

*Primary Examiner*—Howard S. Williams

*Attorney, Agent, or Firm*—Dennison, Meserole, Pollack & Scheiner

[57] ABSTRACT

This invention relates to an electrolysis process and cell for producing a metal by electrolyzing halides in a molten salt bath. It consists of using one cathode in the form of a basket, simultaneously passing a current $I_1$ between this cathode and the anode in such a manner as to carry out a first deposit of crude metal in the basket and a current $I_2$ between the said basket and the complimentary cathodes for depositing the final metal thereon. The cell consists of a central anodic system, a tubular cathodic basket surrounding the anode and a series of cathodes surrounding this basket, a positioning which can be reversed in relation to the basket. The invention finds its application in the continuous production of good quality refractory metal with a suitable material and electric yield.

11 Claims, 2 Drawing Figures

Figure 1:
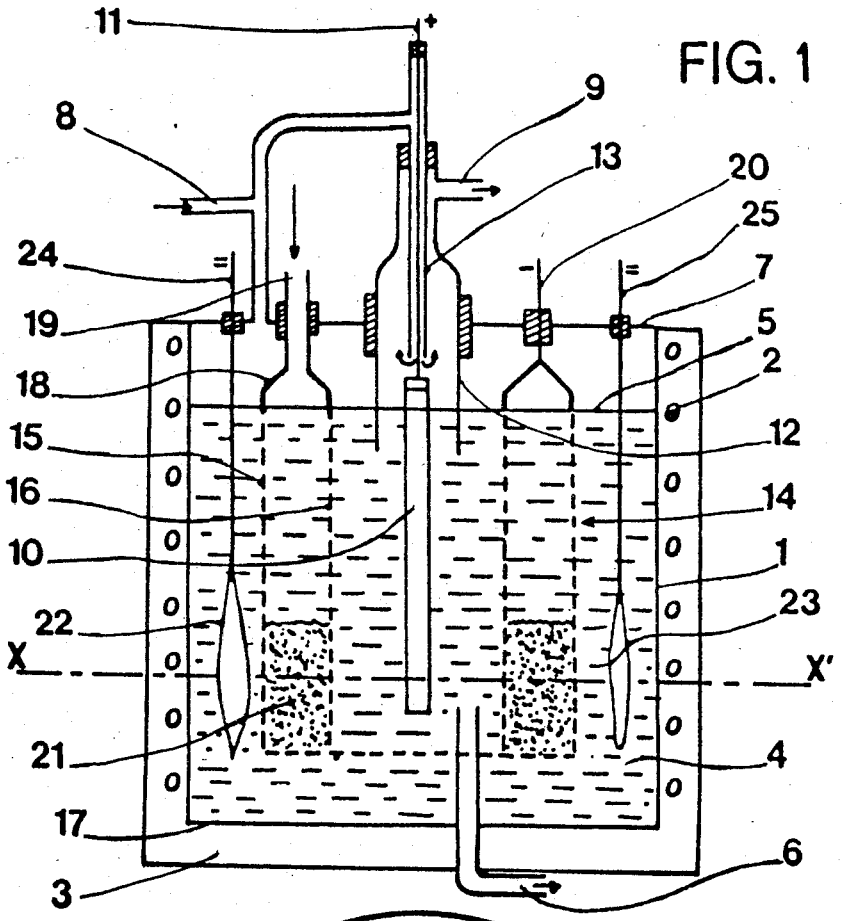

PROCESS FOR THE PRODUCTION OF A METAL BY ELECTROLYZING HALIDES IN A MOLTEN SALT BATH, COMPRISING A SIMULTANEOUS AND CONTINUOUS DOUBLE DEPOSIT

This invention relates to a process for the production of a metal by electrolyzing halides in a molten salt bath comprising a simultaneous and continuous double deposit and to devices for carrying out the said process.

The metals in question include all those metals which have a melting point of above 1000° C. and, preferably, several states of valence, such as titanium, zironium, hafnium, thorium, vanadium, niobium, tantalum, chromium, molybdenum, tungsten, uranium, plutonium as well as rare earth metals in particular.

Those skilled in the art know that is is possible to produce the deposit of a metal by introducing one of its derivatives, such as halide, for example into a molten salt bath and by subjecting it, in its simplest principle, to the action of two electrodes linked to the poles of a source of direct current: halogen is released at the anode and the metal is deposited at the cathode. This technique, so-called electrolysis in the dry way, has been the subject of numerous studies which have resulted in the conception of various processes which differ from each other in the composition of the bath, the physical and chemical state of the halide, the modulation of the rate of current applied and in the production of numerous devices which differ in structure and shape, particularly at the level of the electrodes, halide injection systems and deposited metal recovery systems.

However, the cells have one common characteristic, that is the presence of a porous diaphragm which separates the anode from the cathode and divides the bath into two distinct volumes: the anolyte and the catholyte. This diaphragm particularly has the effect of preventing the halogen which has been released at the anode reoxidising the reduced halides dissolved in the electrolyte when the metal comprises several valences.

This diaphragm can be of ceramic or be produced by depositing a refractory metal on a suitably polarized metal lattice.

The present invention uses a basket-shaped metallic cathode which, while acting as a diaphragm, above all acts as first receiver for the metal to be deposited. GB No. 781,311 and U.S. Pat. No. 3,282,822 describe processes which could be related to our invention.

The first describes a parallelepiped cell enclosing a chloride bath; it is divided by a vertical partition into two compartments which communicate with each other by a space situated between the lower part of the partition and the bottom of the cell. A metal billet constituting the anode projects into one of the compartments and a cathodic construction of perforated sheet into the other, consisting of a tubular cathode and a concentric cathodic basket, fed with halide, of the metal to be deposited. According to the inventor, when this cell functions with gaseous titanium tetrachloride, the distribution of current on the cathodic surfaces is such that it forms dichloride which is rapidly reduced to metal, not only in the proximity of the peripheral walls of the basket, but also in the proximity of the peripheral walls of the central tube, while it deposits trichloride between these two regions. As the trichloride is reduced less raidly to metal than the dichloride, this results in the maintenance of a great difference in concentration in chlorides reduced in the bath, which has the effect of producing metal crystals which are relatively large in size, on the cathodic walls of the basket. These crystals are then recovered, when the cell has stopped, by taking the basket out of the bath and detaching them from the wall. The basket is then reimmersed for undertaking a new electrolysis operation.

U.S. Pat. No. 3,282,822 firstly recalls the difficulties encountered with the processes such as the one which has just been described, notably concerning the simultaneous formation of crystals which are very fine and thus very oxidizable and accumulations of crystals which are larger but porous and which capture large quantities of bath between them. For smoothing these, it points out the necessity of a better control of the densities of current and a uniformity of current on the surface of the electrodes. It thus recommends as a means, a cathode in the form of a cubic box having lateral perforated walls, a solid upper wall and a solid base. At the centre of the upper wall of this box, a titanium tetrachloride feed pipe emerges and vertical cathodic bars are suspended in the interior. Other vertical bars are distributed symmetrically around this box in the bath and act as anodes. A vent placed on the cover of the cell allows chlorine produced by electrolysis to be evacuated to the outside.

This cell functions according to two chloride feed systems. In a first stage, the feeding is rapidly carried out such that one mol of $TiCl_4$ is obtained per 10 to 20 Faradays. This results in the formation on the interior walls of the box of fine titanium crystals which develop to form a more or less porous deposit. The quantity of $TiCl_4$ is subsequently increased such that one mol of $TiCl_4$ is obtained per 4.5 to 6.5 Faradays. A concentration of $TiCl_2$ is produced in these conditions, and metal titanium is deposited preferably on the cathodic bars in the form of crystals with ramifications. When the box is full of metal the supply of $TiCl_4$ is interrupted, the current is prolonged for several seconds to exhaust the soluble titanium, then the cathodic box is taken out of the bath and recooled protected by the atmosphere. The metal is then separated from the box, then washed with an acid solution, diluted and dried. The product obtained contains from 50 to 80% of metal having a Brinell hardness of about 120.

If this cell is an advancement over the previous one, as the inventor claims, it nevertheless suffers from the following disadvantages:

- the functioning thereof is discontinued owing to the necessity in each metal production operation, to successively use two different functioning systems and to take the basket out of the bath in order to recover the metal;
- when the cathodic box is taken out of the bath, fine particles of titanium become disengaged. These fine prticles accumulate in the form of mud at the base of the cell and reduce the yield of metal. Moreover, owing to their good electric conductability, they cause the passage of part of the current intended for the electrolysis, thus reducing the electric yield of the cell. This is why is proves necessary to remove these muds periodicaly. This removal can be carried out either in a mechanical manner, which is a very insalubrious operation, or by introducing chlorine as in U.S. Pat. No. 3,607,011 (which refers, moreover, to U.S. Pat. No. 3,282,822 mentioned above), in such a manner as to transform the metal into $TiCl_4$, a halide which then escapes from the bath by vaporisation and which is condensed with a view to subsequent recycling:

the product obtained is heterogeneous since the initial deposit of metal on the walls of the box, at the moment when the quantity of current admitted is large, is of a porous nature, whereas the subsequent deposit on the cathodic bars, with a reduced quantity of current, has larger crystals;

owing to the presence of porous products, the contents of the basket retain a substantial quantity of bath which it is necessary to remove by treatment with an acidic medium;

it is not easy to determine the moment when the power of assimilation of this cell diminishes, such that $TiCl_2$ and $TiCl_3$ appear in the anolyte and are recombined with the chlorine released at the anode, which reduces the material yield of the the operation.

This is why the object of the invention is to propose a process in which, on the one hand, halides are supplied and reduced continuously and in a simultaneous manner while constantly maintaining the basket in the bath in a manner such as to prevent discontinuity in operation and the formation of muds; on the other hand, an essentially crystallized, homogeneous metal is obtained, which does not enclose the bath; likewise elements which contribute to improving both the capacity of production, the material and electric yields, the working conditions and the quality of the products produced.

The invention essentially consists of a process for the production of a metal by electrolyzing halides in a molten halide bath comprising a double simultaneous and continuous deposit in which a first deposit is formed by circulating a direct electric current $I_1$ from an anodic system to a deposit cathode in the form of a basket, both of these being immersed in the bath, and the basket is fed with a halide of the metal to be deposited. This process is characterised in that a current $I_2$ is simultaneously circulated from the basket to at least one complimentary cathode in such a manner as to form a second deposit on it, in that the said complimentary cathode is periodically extracted from the bath in order to recover the metal obtained and is simultaneously replaced by another cathode.

Thus, in contrast to the process of the prior art, the metal can be deposited under the influence of the current $I_1$ in a more or less heterogeneous form. Under the action of the current $I_2$, this metal is then ionised and transported towards the complimentary cathode(s) where it forms an essentially crystalline homogeneous deposit, which has no porosity and retains practically no bath. It is thus sufficient to take the cathode out of the bath and to let it cool by the protection of air so as to easily recover a suitable well crystallized metal, without intermediate treatment, to be agglomerated by fusion. This process must have a substantial advantage over that of U.S. Pat. No. 3,282,822 in which a metal is obtained which is distributed simultaneously on the perforated walls of a box and on the interior cathodic bars, the recovery of which proves difficult and the quality of which differs according to the position from where it has been taken; this is due to the formation of two types of deposits corresponding to two successive halide feed rates, not to mention the presence of nonreduced halides.

In the process according to the invention, the ratio between the currents $I_1$ and $I_2$ can be acted on easily and at any time, that is, the quantity of metal deposited in the basket can be increased by reducing the transfer to the cathode or, by contrast, by reducing the quantity of metal deposited in the basket by increasing the transfer to the cathode. If, when in operation, a certain equilibrium and thus a constant volume in time of metal deposited in the basket, is achieved clogging-up of the walls of the basket can begin to take place owing to irregularities in the flow rate of halides or other disturbances; in this case, it is sufficient to increase $I_2$ in order to dissolve the inhibiting deposits and possibly the muds, and to reestablish correct operation. If necessary, either the current $I_1$ or the current $I_2$ can be interrupted during a given time, such that the ratio $I_1/I_2$ can vary from 0 to infinity without any repercussions on the quality of the metal produced. This presents a substantial advantage over the process of the prior art in which, during clogging-up, the only possible course was to stop the electrolysis and withdraw the basket from the bath, thereby recovering a metal strongly polluted by halides which were not able to be reduced.

The process as described above corresponds to the operating conditions at cruising rate. However, it is advisable, at the beginning of the operation, to follow a particular proces, firstly consisting of forming a reserve of metal in the basket. For this, the current $I_1$ is solely circulated between the anode and the basket while several successive halide charges are introduced into the cell. When the discharged quantity of electricity corresponds to a filling with metal of $\frac{1}{2}$ to $\frac{2}{3}$ of about the volume of the basket, the halide of the metal to be deposited which is reduced to the valent 0 at the cathode in a single stage, is introduced into the compartment demarcated by the interior walls of the cell and the exterior walls of the basket, such that a content of combined metal of from 1 to 7% by weight is obtained; this is in order to prevent the formation of pulverulent products. A current $I_1$ and a current $I_2$ are simultaneously passed at this moment while continuing to feed the basket with halide. The cell thereby acquires its cruising rate. It then only remains to regularly withdraw the cathode(s) from the bath to recover the metal and replace them with virgin cathodes. In the case of n cathodes, the procedure is as follows: a single cathode having been placed in the bath at the outset, the $n-1$ are successively immersed, and the others at regularly spaced intervals such that, at the moment of immersion of the $n^{th}$, the first is covered by the desired quantity of refined metal.

The above description demonstrates feeding of halide alone. But the process also adapts well to a mixture of halide and bath, the latter circulating between the electrodes and being continuously extracted and recycled after recharging with halide of the metal which is to be deposited.

The process according to the invention allows the supply of halide not only in a liquid form but also in a solid form, thereby differing from the process of U.S. Pat. No. 3,282,822 which merely admits in the case of titanium tetrachloride and which is preferably gaseous. This extention to the three physical states of the material is the result of the production of a deposit in two stages which frees the process from constraints on the quality of the metal present in the basket, since the latter only constitutes a transitory phase of obtaining it.

The process is applicable to most halides of the type M (halide)$_X$, where M is a metal such as titanium, zirconium, hafnium, thorium, vanadium, niobium, tantalum, chromium, molybdenum, tungsten, uranium, plutonium, rare earth metals and X is one of the valences of the metal being considered. It can also apply to metals which it is difficult to obtain directly in a correct crystalline state.

Thus, in the case of titanium, all the halides of the type $TiCl_X$ in which X has a value equal to or from 2 to 4, can be put into operation. Thus, in contrast to the aforementioned U.S. patent, in addition to $TiCl_4$, $TiCl_3$ or $TiCl_2$, either a mixture of these or a partially reduced product can be used in which, for example, X is about 2.3.

The sub-chlorides have an advantage over the $TiCl_4$ of being soluble in the molten salt bath and thus giving a more homogeneous bath. They furthermore permit a better control of the quantity of halides introduced and therefore allow the content of combined titanium in the basket to be limited and thus reduce the diffusion of titanium ions to the anode and subsequent losses due to anodic reoxidation.

The possibility of using sub-chlorides thus presents previous technology with important advancement which could only be envisaged in that it was not necessary to impose particular metallurgic characteristics on the metal deposit of the basket, as is the case in the present process and which places interest in it.

The molten salt bath used is chosen according to the metal to be deposited. Thus, for titanium, a mixture of calcium chlorides, barium and sodium is preferably used in suitable proportions. This bath has the advantage of having a composition which is similar to that of the bath used for the electrolytic production of sodium: a loop can thus be conceived comprising the prereduction of $TiCl_4$ to $TiCl_X$ by sodium and the recirculation of the bath from the anodic compartment to the sodium electrolysis cell.

As for the intensities of current applied, these depend principally on the metals to be deposited, on the type of halide and the feeding speed and thus form the subject of specific adaptations.

The present invention also relates to two devices for obtaining metals. They consist of a cell from electrolyzing halides of the metal to be deposited, contained in a molten halide bath consisting of a cylindrical vat designed to contain the said baths under the protection of the atmosphere, an anodic system comprising at least one cylindrical anode plunging into the bath, a cathode in the form of a mechanical lattice basket suspended in the bath, consisting of two coaxial vertical cylinders bound to a perforated base or not extending as far as the axis, a halide feed system positioned on the upper part of the cathode and between the two cylinders, the means for drawing the released halogen off by suction, the means for joining the upper parts of the anodic system and the cathodic system to the positive and negative poles respectively of each source of direct current, characterized in that the anodic system is positioned at the centre of the cell and is surrounded symmetrically by the basket, in that at least one complimentary cathode, and preferably two, joined by their upper part to a source of current with a more strongly negative potential than that of the basket, are positioned in the compartment demarcated by the exterior walls of the cell and the exterior walls of the basket in a symmetrical manner and are provided with the means for withdrawing from the bath protected by air.

This cell thus comprises, as in U.S. Pat. No. 3,282,822 and GB No. 781,311, a cathode in the form of a basket, an anodic system, the means for feeding halides, injecting inert gas and evacuating halogen, but it also includes other means.

Firstly, the anodic system occupies a central position in the electrolysis cell and it is surrounded in a symmetrical manner by the cathodic basket, such that the entire interior lateral wall and the entire exterior lateral wall of the said basket are each equidistant from the anode. Such a positioning produces an electric field in the anolyte, distributed in a regular manner, which prevents local difusions of titanium ions to the anode and encourages the supply of released halogen.

It is to be noted that the presence of a perforated base or not at the base of the basket which extends as far as the axis of the cell, contributes towards forming a compartment where the anolyte is electrically separated from the rest of the bath and stresses the advantages caused by the symmetry of the basket and the anode.

The insulation of the anolyte can, however, be further stressed by producing a double base, the interior of which communicates or not with the basket itself.

The basket consists of a metal lattice of nickel, the mesh of which has dimensions such that it prevents the easy passage of metal particles without causing clogging.

The upper part of the basket emerges from the bath and can be opened or closed. In these two cases, it is linked on the one hand with the halide feed system and on the other hand with the negative pole of a source of current by impervious passages formed on the cover of the cell.

Regarding the central anodic system, it preferably consists of a cylindrical section of graphite, cut longitudinally with a view to encouraging gaseous release, joined to a positive pole of a source of current and positioned at the interior of a bell fixed in an impervious manner to the cover of the cell and by which the halide is conveyed to an exterior catchment.

One or more cathodes, preferably of iron, nickel, titanium or a metal to be deposited which serve to receive the final metal are positioned around the basket in a symmetrical manner. This positioning allows a regular distribution of the current of the second deposit and a uniform metal deposit to be obtained. It also contributes towards facilitating the recovery of metal owing to good accessibility of the said cathodes. By using a sufficient number of cathodes, the density of cathodic current is reduced and the quality of the deposit is favoured. Such a deposit results in the division of the cell into three distinct compartments: one anodic compartment in which the quantity of titanium bath is practically zero, one compartment consisting of the basket in which the bath is very rich in titanium ions and one cathodic compartment demarcated by the interior walls of the cell and the exterior walls of the basket, in which the titanium content of the bath is relatively low and of the order of a few % by weight. Thus an original structure is achieved which is perfectly adapted to the application of the process according to the invention.

However, this is only a preferential non-limiting device and every other variant such as that, for example, consisting of reversing the positioning of the anodic system and the cathodic system in relation to the basket, is part of the invention. This last device has the advantage of regrouping the cathodes at the centre of the cell, which results, notably, in a reduction in the number of devices for extracting the said cathodes.

In the case in which it is desired to feed the cell with a mixture of bath and halide of the metal to be deposited, the base of the cell is provided with a perforation for extracting bath which issues into the anodic compartment. The bath is thus recycled continuously towards the basket after being suitably recharged with halide of the metal to be deposited.

Figure 2:
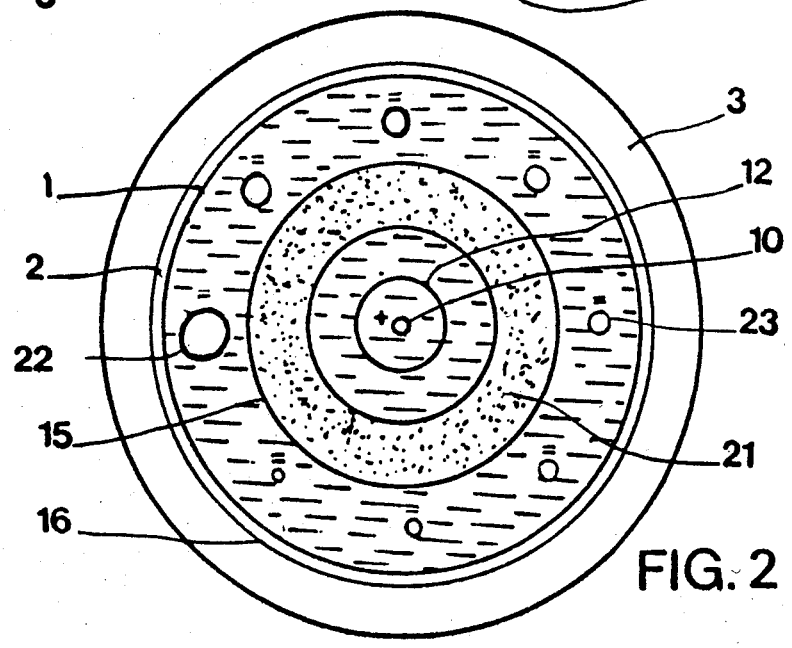

The invention can be better understood by means of the attached drawings which represent in FIG. 1 a section following an axial plan of an example of a cell according to the invention and in FIG. 2 a section of the same cell following a horizontal plan marked from XX' in FIG. 1.

In FIG. 1, a cylindrical vat (1) can be distinguished, provided on the exterior with heating circuits (2), a thermal covering (3) and provided in the interior with a molten salt bath (4) up to the level (5) and provided on its lower wall with an outlet orifice (6) from the bath. A pipe (8) for injecting inert gas projects from the cover (7) of the cell. Crossing the said cover and, plunging into the bath, can be seen:

- a central anode (10) with an exterior extension (11) designed to connect with the positive pole of a source of direct current;
- a bell (12) surrounding the anode and its exterior extension (11) consisting of a pipe (13) connected to the pipe (8) for injecting inert gas in such a manner at to facilitate the transportation of the halogen from the cell through the pipe (9);
- a tubular cylindrical basket (14) of metal lattice consisting of an exterior wall (15) and an interior wall (16) a base (17) which extends as far as the axis of the cell, a sealing arch (18) positioned below the level of the bath and provided with a conduit (19) for feeding bath and halide and an exterior extension (20) designed to connect with the negative pole of a source of direct current;

the basket contains a certain volume of metal (21);

- two cathodes (22) and (23) positioned in the compartment demarcated by the interior walls of the cell and by the exterior walls of the basket, covered with a metal deposit with their exterior extension (24) and (25) designed to connect with the negative pole of a source of direct current with a more negative potential than (20);

In FIG. 2, some of the elements of FIG. 1 can be seen, that is: the cell (1), the heating system (2), the thermal covering (3), the central anode (10) and the bell (12), the basket and its exterior wall (15) and interior wall (16) containing the metal (21) and eight cathodes, two of which are localized (22) and (23), covered with a metal deposit of decreasing thickness when turned in a clockwise direction starting from (22), a cathode which has been in the bath for the longest period.

The invention can be illustrated by means of the following example of application:

In a Hastelloy C cell, with an interior diameter of 235 mm and a height of 700 mm, provided with a heating system, and in the interior of which a cylindrical vat of nickel with a diameter of 220 mm and a height of 300 mm is positioned, 13.7 kg of a eutectic $BaCl_2$—$CaCl_2$—NaCl (16.3-46.9-36.7 mol%) are charged. After positioning an impervious cover provided with a graphite anode and a nickel cathode and different sealing pipes, the cell is placed under vacuum at about 550° C. to eliminate humidity, then is treated with HCl to eliminate oxides, hydroxides, and other impurities contained in the bath, then electrolysis is carried out under a continuous tension of 2.2 V until the residual current stabilizes.

The cover is then removed and an annular cylindrical basket it introduced into the bath, produced by means of a reinforcement of nickel wire with a diameter of 3 mm covered by a wire mesh of nickel wire with a diameter of 0.28 mm plaited to a mesh of 35 mesh. Then the cover is replaced, which is provided with a central anode and its bell, its complementary cathodes, different inlet and outlet pipes for gas and the halide feed system.

The atmosphere of the cell is cleared under vacuum, then under argon, then reheated to 550° C. The bath being liquid, different electrodes are plunged therein. The height of the bath in the cell is then 150 mm.

Moreover, a solution of $TiCl_X$ is prepared in the molten salt bath, where X is 2.3 by oxidation of titanium powder by titanium tetrachloride. This solution includes about 10% by weight of titanium under the form of halide.

This $TiCl_X$ is introduced at a rate of 6 g/h into the cell and a tension of 3.5 V is applied. The current $I_1$ then has a value of 2 A.

After introduction into the basket of 1,500 g of salt bath containing 10% of titanium in the form of $TiCl_X$, the metal deposited in the basket occupies about half of its volume. The removal of bath carried out near the complimentary cathode shows a perfectly white salt to be present, that is containing no trace of sub chloride, a result which is, moreover, confirmed by the analysis.

The compartment demarcated by the interior walls of the cells and the exterior walls of the basket is then supplied with $TiCl_X$ until a composition is obtained of from 1.5 to 2% by weight of titanium and and a tension of −0.9 V is applied between the cathode and the basket. A current $I_2$ is established with an average value of 1.5 A.

After operating for 8 h a deposit of well crystallized metal is formed on the cathode having only from 1 to 2% by weight of molten salts. The collective weight is 2.3 g.

The operation is carried out over a period of 66 h. The tensions, intensities and weights of metal obtained are set out in the following table:

| first deposit | | second deposit | | | |
|---|---|---|---|---|---|
| V (Volts) (anode-basket) | $I_1$ (A) | V (Volts) (athode-basket) | $I_2$ (A) | duration in h | titanium deposited on the cathode in g |
| 4.9 | 2.5 | −0.9 | 1.15 | 7 | 6.13 |
| 3.9 | 2 | −1 | 1.7 | 7 | 4.28 |
| 3.9 | 2.1 | −0.9 | 1.8 | 7 | 3.90 |
| 2.4 | 0.5 | −0.9 | 1.4 | 15 | 6.8 |
| 2.4 | 0.55 | −1 | 1.3 | 15 | 9.87 |
| 2.9 | 1.4 | −1.2 | 1.45 | 15 | 11.14 |

The metal obtained has the following analysis in ppm:

| | |
|---|---|
| $O_2$ | 210–230 |
| Al | 130 |
| Fe | 10 |
| V | 55 |

and its Brinell hardness is on average 80.

We claim:

1. A process for the production of a metal by electrolyzing halides in a molten halide bath comprising a simultaneous and continuous deposit double, characterised in that a direct electric current $I_1$ is firstly circulated from an anodic system to a cathode in the form of a basket, both of these being immersed in the bath, while feeding the basket with a halide of the metal to be deposited, until the quantity of electricity produced corresponds to a filling of from $\frac{1}{3}$ to $\frac{2}{3}$ of the volume of the basket by the metal, then the halide of the metal is introduced into the compartment demarcated by the interior walls of the basket, such that a combined metal content of from 1 to 7% by weight is obtained, then a current $I_2$ is simultaneously circulated with the current $I_1$, from the basket to at least one complimentary cathode, while continuing to feed the basket with halides, and the said complimentary cathode is periodically extracted to recover the metal obtained and replace it by another cathode.

2. A process according to claim 1, characterised in that the ratio $I_1/I_2$ is modified at any moment.

3. A process according to claim 1, characterised in that the feeding of halide of the metal to be deposited is carried out in the form of a mixture with the bath, which is circulated between the electrodes, continuously drawn off and recycled after recharging with halides.

4. A process according to claim 1, characterised in that halides in a solid state are fed in.

5. A process according to claim 4, characterised in that the metal is titanium and the halide is $TiCl_X$ where X is equal to or from 2 to 4.

6. A process according to claim 5, characterised in that X is from 2 to 3.

7. A process according to claim 6, characterised in that X is about 2.3.

8. A process according to claim 1, characterised in that at the start of the operation, if n cathodes are used, a single cathode is plunged into the bath, then the n−1 others are successively and periodically plunged into the bath in a manner such that when the $n^{th}$ is plunged in, the first is covered by a desired quantity of refined metal.

9. A process according to claim 1, characterised in that a halide M $(Halog)_X$ of a metal is put into operation, having a melting point which is generally greater than 1,000° C.

10. A process according to claim 9, characterized in that the metal has several states of valence.

11. A process according to claim 10, wherein the metal is selected from the group comprising titanium, zirconium, hafnium, thorium, vanadium, niobium, tantalum, chromium, molybdenum, tungsten, uranium, plutonium and rare earth metals having several states of valence.

* * * * *

UNITED STATES PATENT AND TRADEMARK OFFICE

CERTIFICATE OF CORRECTION

PATENT NO. : 4,588,485
DATED : May 13, 1986
INVENTOR(S) : Joseph Cohen and Gerard Lorthioir It is certified that error appears in the above-identified patent and that said Letters Patent are hereby corrected as shown below:

Column 8, second line from the bottom, "deposit double" should read --double deposit--; and Column 9, after line 7, there should be inserted --walls of the cell and the exterior--.

Signed and Sealed this

Twelfth Day of January, 1988

*Attest:*

DONALD J. QUIGG

*Attesting Officer*

*Commissioner of Patents and Trademarks*